United States Patent [19]

Osaki et al.

[11] Patent Number: 4,844,039

[45] Date of Patent: Jul. 4, 1989

[54] FUEL SUPPLY CONTROL SYSTEM FOR INTERNAL COMBUSTION ENGINES

[75] Inventors: Shunzaburo Osaki; Eitetsu Akiyama, both of Wako, Japan

[73] Assignee: Honda Giken Kogyo K.K., Tokyo, Japan

[21] Appl. No.: 184,353

[22] Filed: Apr. 21, 1988

[30] Foreign Application Priority Data

Aug. 25, 1987 [JP] Japan ..... 62-210910

[51] Int. Cl.[4] ..... F02D 41/06

[52] U.S. Cl. ..... 123/491; 123/480

[58] Field of Search ..... 123/491, 480, 486, 179 L, 123/179 G; 364/431.1

[56] References Cited

U.S. PATENT DOCUMENTS

| | | | |
|---|---|---|---|
| 4,176,134 | 3/1986 | Yamato et al. | 123/491 |
| 4,564,907 | 1/1986 | Mouri et al. | 123/491 |
| 4,705,004 | 11/1987 | Takahashi et al. | 123/491 |
| 4,723,523 | 2/1988 | Katayoka et al. | 123/491 |
| 4,735,184 | 4/1988 | Kasanami et al. | 123/491 |
| 4,739,741 | 4/1988 | Iwata et al. | 123/491 |
| 4,751,909 | 6/1988 | Otobe | 123/491 |

*Primary Examiner*—Raymond A. Nelli
*Attorney, Agent, or Firm*—Arthur L. Lessler

[57] ABSTRACT

A fuel supply control system for an internal combustion engine comprises a start detecting device for detecting a starting condition of the engine, and a starting fuel supply device for supplying an amount of fuel required for starting the engine which corresponds to an output generated from a device for detecting an engine temperature, when the start detecting device detects the starting condition of the engine. A timer is associated with the start detecting device for counting time elapsed from the time the start detecting device detects the starting condition of the engine and generating an output corresponding to the elapsed time. A fuel decreasing device is responsive to respective outputs from a throttle opening sensor and the timer, for decreasing the amount of fuel for starting the engine, supplied by the starting fuel supply device.

6 Claims, 4 Drawing Sheets

FUEL INJECTION VALVE
6
INTERNAL COMBUSTION ENGINE
1
Ne
10
Tw
9
ELECTRONIC CONTROL UNIT (ECU)
5
11
11a
12
2
7
8
PBA
3
3'
4
θTH

FUEL SUPPLY CONTROL SYSTEM FOR INTERNAL COMBUSTION ENGINES

BACKGROUND OF THE INVENTION

This invention relates to a fuel supply control system for an internal combustion engine, and more particularly to such a control system, which can properly control a fuel quantity to be supplied to the engine at the start of the engine.

Fuel supply control systems for an internal combustion engine are known e.g. from Japanese Patent Publications No. 57-27972 and 60-29824, in which excessive enrichment of an air/fuel mixture to be supplied to the engine at starting, and smoldering of ignition plugs which are wetted with fuel due to the excessive enrichment, are prevented in order to improve the startability of the engine.

According to the Japanese Patent Publication No. 57-27972, the opening of a throttle valve in the intake passage of the engine is detected at the start of the engine, and fuel supply to the engine is reduced or cut off immediately upon detection of the opening motion of the throttle valve from a closed position to an open position. However, if the driver already depresses the accelerator pedal just before the start of the engine so that the throttle valve is already open at the start of the engine, or if the throttle valve is erroneously detected to be already open at the start of the engine due to the malfunction of a throttle opening sensor, fuel supply is immediately reduced or cut off immediately upon turning on the starter, and consequently a quantity of fuel sufficient for causing firing within combustion chambers cannot be supplied, resulting in failure to start the engine.

According to the Japanese Patent Publication No. 60-29824, a fuel quantity to be supplied to the engine at starting is controlled to be gradually reduced in accordance with the number of crank angle pulses generated from the start of the engine. However, according to this method, it takes much time until the fuel quantity is sufficiently reduced. As a result, an enriched air/fuel mixture is supplied to the engine for a long time after the start of the engine, so that ignition plugs continue to smolder, resulting in failure to start the engine.

SUMMARY OF THE INVENTION

It is the object of the invention to provide a fuel supply control system for internal combustion engines, which is capable of preventing the engine from failing to start, and promptly removing the smoldering of ignition plugs, if it occurs, thereby improving the startability of the engine.

According to the present invention, there is provided a fuel supply control system for an internal combustion engine having an intake passage and a throttle valve arranged across the intake passage, including start detecting means for detecting a starting condition of the engine, engine temperature detecting means for detecting a temperature of the engine and generating an output indicative of the detected engine temperature, throttle opening detecting means for detecting the opening degree of the throttle valve and generating an output indicative of the detected opening degree, and starting fuel supply means associated with the start detecting means and the engine coolant temperature detecting means and responsive to the output of the engine temperature detecting means, for supplying the engine with an amount of fuel required for starting the engine, when the start detecting means detects the starting condition of the engine.

The fuel supply control system according to the invention is characterized by the improvement comprising: time counting means associated with the start detecting means for counting time elapsed from the time the start detecting means detects the starting condition of the engine and generating an output corresponding to the elapsed time, and fuel decreasing means responsive to the outputs of the throttle opening detecting means and the time counting means, for decreasing the amount of fuel for starting the engine, supplied by the starting fuel supply means.

The invention will be more apparent from the ensuing detailed description taken in conjunction with the accompanying drawings.

DETAILED DESCRIPTION

The invention will now be described in detail with reference to the drawings showing an embodiment thereof.

Figure 1:
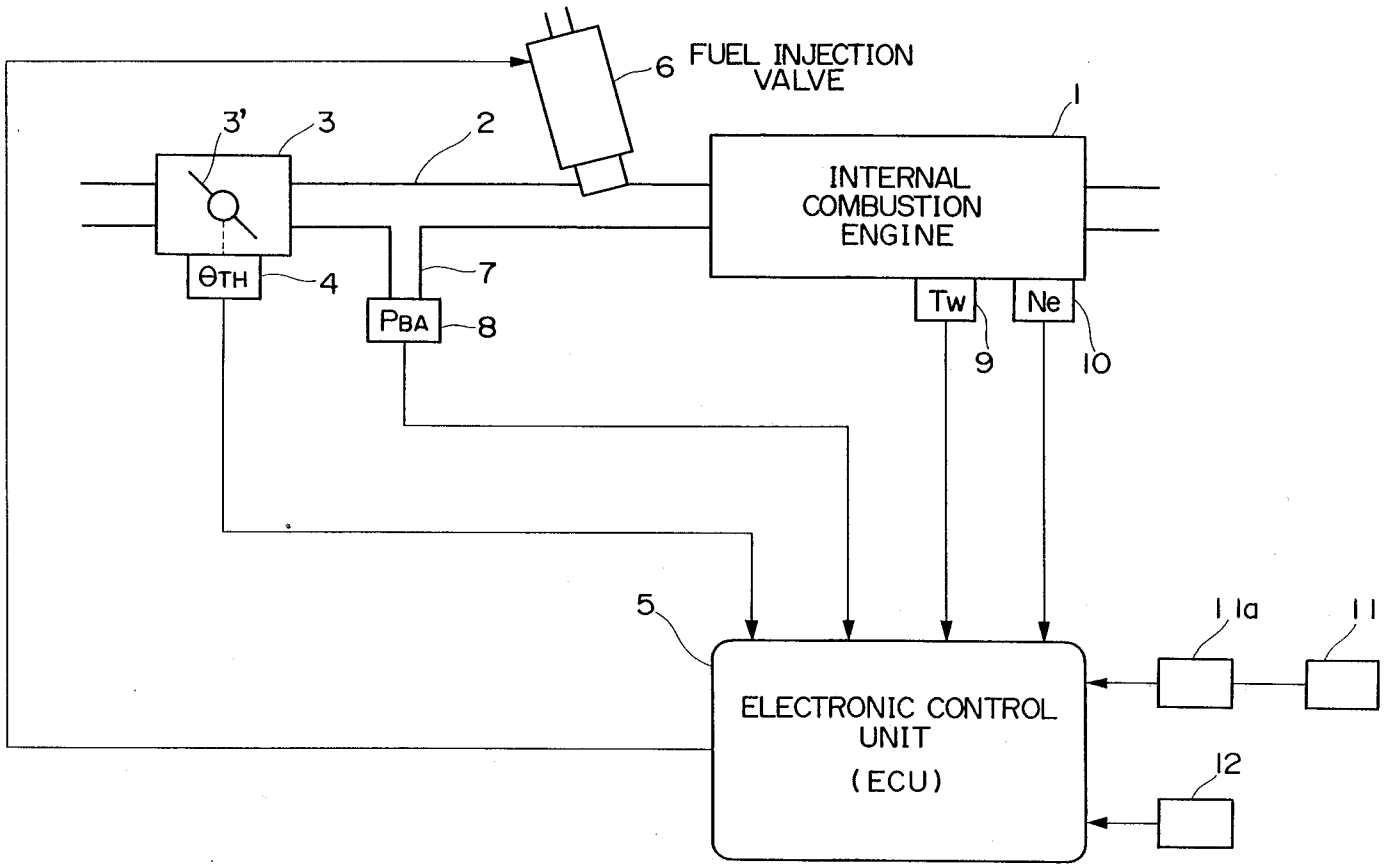
FIG. 1 is a block diagram illustrating the whole arrangement of a fuel supply control system of an internal combustion engine according to the invention.

Referring first to FIG. 1, there is illustrated the whole arrangement of a fuel supply control system of an internal combustion engine according to the invention. In the figure, reference numeral 1 designates an internal combustion engine which may be a four-cylinder type for instance, and to which is connected an intake pipe 2 forming an intake passage. A throttle body 3 is arranged across the intake pipe 2, and accommodates a throttle valve 3'. A throttle valve opening ($\theta_{TH}$) sensor 4 is connected to the throttle valve 3' for sensing its valve opening and is electrically connected to an electronic control unit (hereinafter called "the ECU") 5, to supply same with an electrical signal indicative of the throttle valve opening sensed thereby.

Fuel injection valves 6 (starting fuel supply means) are arranged in the intake pipe 2 each at a location slightly upstream of an intake valve, not shown, of a corresponding one of the engine cylinders, not shown, and between the engine 1 and the throttle body 3, for supplying fuel to the corresponding engine cylinder. The fuel injection valves 6 are connected to a fuel pump, not shown, to be supplied with pressurized fuel therefrom and are electrically connected to the ECU 5, in a manner having their valve opening periods of fuel injection quantities controlled by signals supplied from the ECU 5.

An absolute pressure ($P_{BA}$) sensor 8 communicates through a conduit 7 with the interior of the intake pipe 2 at a location downstream of the throttle valve 3' of the throttle body 3, to sense absolute pressure in the intake pipe 2 and applies an electrical signal indicative of sensed absolute pressure to the ECU 5.

An engine coolant temperature ($T_W$) sensor 9, which may be formed of a thermistor or the like, is mounted on the cylinder block of the engine 1 in a manner embedded in the peripheral wall of an engine cylinder having its interior filled with coolant, of which an electrical output signal indicative of the sensed coolant temperature is supplied to the ECU 5.

An engine speed (Ne) sensor 10 is arranged on a camshaft, not shown, of the engine 1 or a crankshaft of same, not shown. The Ne sensor 10 is adapted to generate one pulse at one of predetermined crank angles whenever the engine crankshaft rotates through 180 degree, i.e. one pulse of the top-dead-center position (TDC) signal. The pulses generated by the sensor 10 are supplied to the ECU 5.

The engine 1 is provided with a starter 11, which drives the engine 1 at cranking or starting. The starter 11 is connected to the ECU 5 via a starter switch 11a which supplies a signal indicative of on-off state of the starter to the ECU 5. The starter switch 11a is constructed as start detecting means together with a central processing unit 503, a level shifter 512, and a data circuit 513, hereinafter referred to.

Further connected to the ECU 5 are other engine operating parameter sensors 12 such as an intake air temperature sensor, an atmospheric pressure sensor, an $O_2$ sensor, and so forth, which supply respective output signals indicative of the sensed parameter values to the ECU 5.

The ECU 5 determines engine operating conditions, based upon the input signals from the above-mentioned various engine operating parameter sensors, and calculates fuel quantity to be supplied to the engine 1, that is, the valve opening period $T_{OUT}$ for the fuel injection valves 6 in response to the determined conditions of the engine 1.

Figure 3:
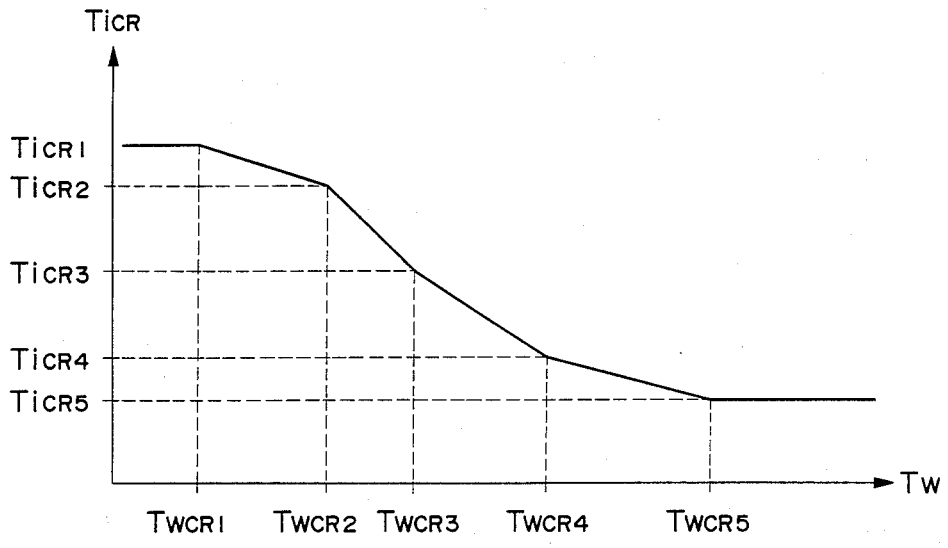
FIG. 3 is a graph showing a table of the relationship between a basic valve opening period $Ti_{CR}$ of fuel injection valves 6 at cranking of the engine and the engine coolant temperature $T_W$.

The valve opening period $T_{OUT}$ for the fuel injection valves 6 at cranking of the engine can be obtained by the use of the following equation (1):

$$T_{OUT}=Ti_{CR} \times K_{CR} \times K_{Ne}+T_V \quad (1)$$

where $Ti_{CR}$ is a basic valve opening period for the fuel injection valves 6 to be applied at the start of the engine 1 in dependence on the engine coolant temperature $T_W$. The value of the basic valve opening period $Ti_{CR}$ is determined, for instance, by means of a $Ti_{CR}$ table in FIG. 3. In the $Ti_{CR}$ table, five predetermined values $Ti_{CR1}$–$Ti_{CR5}$ of the basic valve opening period $Ti_{CR}$ and five predetermined values $TW_{CR1}$–$TW_{CR5}$ of the engine coolant temperature $T_W$ are provided as calibration variables dependent upon the engine coolant temperature $T_W$. If the detected engine coolant temperature $T_W$ value falls between adjacent ones of the predetermined values $TW_{CR1}$–$TW_{CR5}$, the basic valve opening period $Ti_{CR}$ is calculated by an interpolation method.

$K_{CR}$ is a basic valve opening period correction coefficient according to the present invention which is determined by means of a control program shown in FIG. 4, hereinafter referred to. $K_{Ne}$ is a correction coefficient which is determined in response to engine rotational speed. $T_V$ is a correction variable which is determined in response to the output voltage of a battery, not shown, for supplying electric power to the ECU 5, etc.

Figure 2:
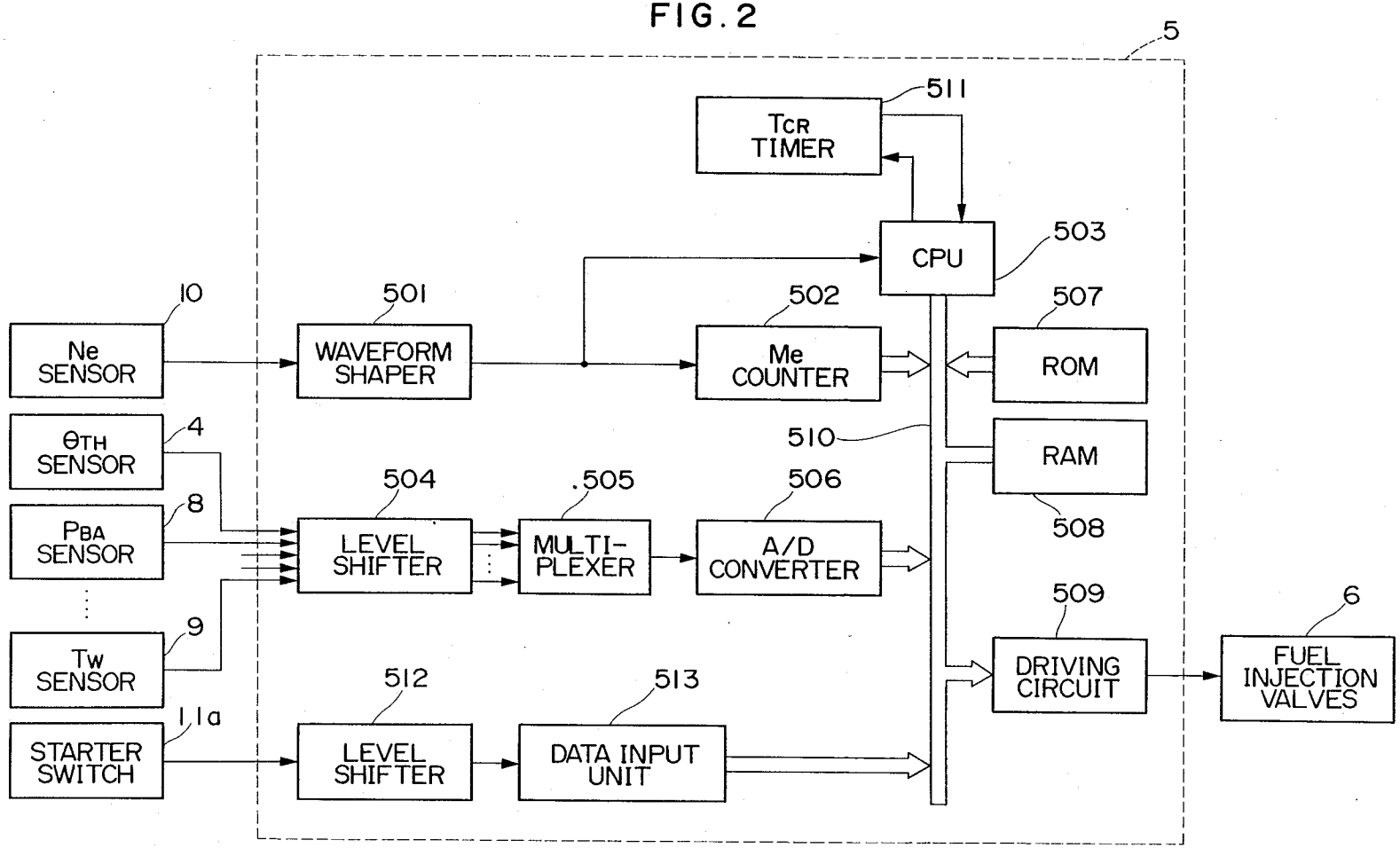
FIG. 2 is a block diagram illustrating the interior arrangement of an electronic control unit (ECU) 5 appearing in FIG. 1.

FIG. 2 shows a circuit configuration within the ECU 5 in FIG. 1. An output signal from the Ne sensor 10 in FIG. 1 indicative of the rotational speed of the engine is applied to a waveform shaper 501, wherein it has its pulse waveform shaped, and supplied as the TDC signal to a central processing unit (hereinafter called "the CPU") 503. The CPU is constructed as fuel decreasing means in the present embodiment. The TDC signal is supplied to an Me value counter 502, as well. The Me value counter 502 counts the interval of time between a preceding pulse of the TDC signal and a present pulse of the same signal, inputted thereto from the Ne sensor 10. Therefore, its counted value Me corresponds to the reciprocal of the actual engine rotational speed Ne. The Me value counter 502 supplies the counted value Me to the CPU 502 via a data bus 510.

Respective output signals from the throttle valve opening ($\theta_{TH}$) sensor 4, the absolute pressure ($P_{BA}$) sensor 8, the engine coolant temperature ($T_W$) sensor 9, all appearing in FIG. 1, and other sensors have their voltage levels shifted to a predetermined voltage level by a level shifter circuit 504 and successively applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

The on-off state signal from the starter switch **11*a* in FIG. 1 has its voltage level shifted to a predetermined voltage level by a level shifter 512 and, after being converted into a predetermined signal in a data input circuit 513, is supplied to the CPU 503 via the data bus 510**.

A $T_{CR}$ timer 511 as time-measuring means is connected to the CPU 503. The CPU 503 supplies the $T_{CR}$ timer 511 with a signal which causes same to be actuated or stopped, while the $T_{CR}$ timer 511 supplies the CPU 503 with a signal indicative of the counted value thereof.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores the aforementioned $Ti_{CR}$ table, as well as control programs to be executed within the CPU 503, such as one in FIG. 4 hereinafter referred to, and so on. The CPU 503 executes a fuel supply control program stored in the ROM 507 to calculate the fuel injection period $T_{OUT}$ for the fuel injection valves 6 in response to the various engine operating parameter signals, and supplies the calculated period value to the driving circuit 509 through the data bus 510. The driving circuit 509 supplies driving signals corresponding to the above calculated $T_{OUT}$ value to the fuel injection valves 6 to drive same.

Figure 4:
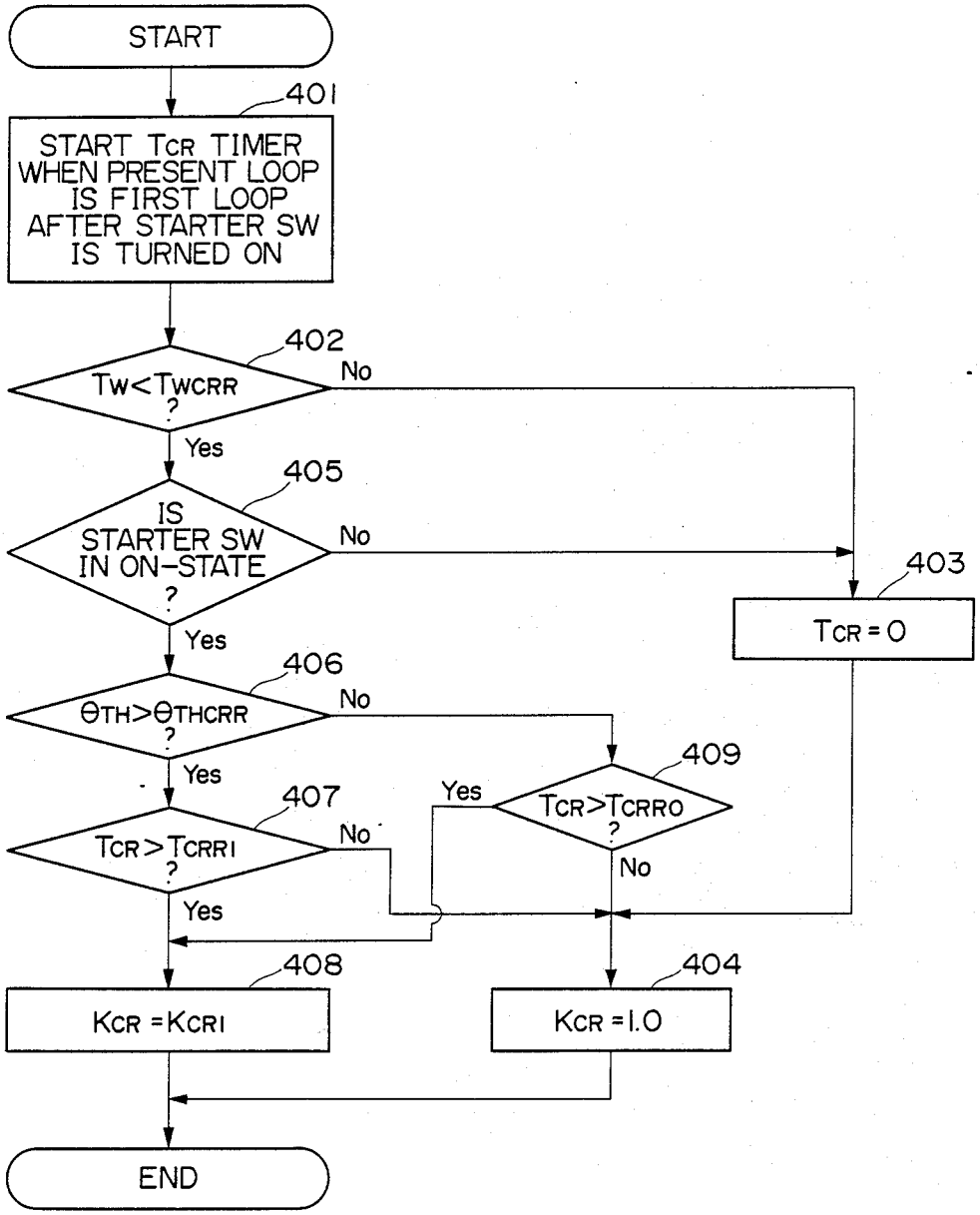
FIG. 4 is a flow chart showing a manner of determining the basic valve opening period correction coefficient $K_{CR}$ of the fuel injection valves 6 at cranking of the engine.

Referring to FIG. 4, the control program is shown therein which determines the aforementioned basic valve opening period correction coefficient $K_{CR}$ (hereinafter called "coefficient $K_{CR}$") according to the present invention, which is executed by the CPU 503 in FIG. 2 in synchronism with generation of the TDC signal, i.e. whenever each pulse of the TDC signal is inputted to the CPU 503.

First, when the present loop is the first loop after the starter switch 11a is turned on, the $T_{CR}$ timer 511 is started by the signal from the CPU 503 (step 401). The $T_{CR}$ timer 511 is adapted to count clock pulses corresponding to elapsed time after the engine 1 starts to operate.

Next, it is determined whether or not the value of the engine coolant temperature $T_W$ is smaller than a predetermined value $T_{WCRR}$ (e.g. 105° c) at step 402. If the answer to the question if No, that is, if $T_W \geqq T_{WCRR}$, which means the engine coolant temperature $T_W$ is extremely high, the counted value $T_{CR}$ of the $T_{CR}$ timer 511 which has been started at step 401 is reset to zero at step 403, since at such a high temperature the degree of atomization of fuel would be so high that there occurs no smoldering of ignition plugs. Then, at step 404, the value of the coefficient $K_{CR}$ is set to a value of 1.0, which is followed by termination of the program. Thus, in this case, the basic valve opening period $Ti_{CR}$ is not corrected actually.

If the answer to the question of the step 402 is Yes, that is, if $T_W < T_{WCRR}$, it is determined whether or not the starter switch 11a is in on-state at step 405. If the answer to the question of the step 405 is No, that is, if the switch 11a is not in on-state, the steps 403 and 404 are executed, followed by termination of the program, since it is judged that the engine 1 is no longer cranking or starting.

If the answer to the question of the step 405 is Yes, that is, if the starter switch 11a is in on-state, it is determined whether or not the throttle valve opening $\theta_{TH}$ is larger than a predetermined value $\theta_{THCRR}$ (e.g. 70° C.) at step 406. If the answer to the question of the step 406 is yes, that is if $\theta_{TH} > \theta_{THCRR}$, which means the throttle valve 3' is sufficiently opened, it is determined whether or not the counted value $T_{CR}$ of the $T_{CR}$ timer 511 is larger than a value corresponding to a second predetermined period of time $T_{CRR1}$ (e.g. 1.0 sec) at step 407. If the answer to the question of the step 407 is No, that is, if the second predetermined period of time $T_{CRR1}$ has not yet elapsed from the start of the engine 1, the step 404 is executed to set the coefficient $K_{CR}$ to 1.0, which means the basic valve opening period $Ti_{CR}$ is not corrected actually. On the other hand, if the answer to the question of the step 407 is Yes, that is, if the second predetermined period of time $T_{CRR1}$ has elapsed from the start of the engine 1, the value of the coefficient $K_{CR}$ is set to a predetermined value $K_{CR1}$ smaller than the value of 1.0, e.g. 0.2, at step 408, followed by the excecution of correcting the basic valve opening period $Ti_{CR}$ by means of the predetermined value $K_{CR1}$ to which the coefficient $K_{CR}$ has been set, which is followed by termination of the program.

As described above, even if the throttle valve 3' is already sufficiently open at the start of the engine 1, correction of the quantity of fuel to a reduced value by means of the coefficient $K_{CR}$ is not executed, until at least the second predetermined period of time $T_{CRR1}$ elapses from the start of the engine 1. Therefore, even if the driver already depresses the accelerator pedal just before turning the starter 11 on or steps on the pedal simultaneously upon turning the starter 11 on, or even if there occurs malfunction in the $\theta_{TH}$ sensor 4, the fuel quantity at least sufficient for firing within combustion chambers is supplied to the engine 1, thereby preventing the failure to start the engine 1. Further, since the fuel quantity reducing correction by means of the coefficient $K_{CR}$ is executed immediately after the second predetermined period of time $T_{CRR1}$ elapses from the start of the engine 1, smoldering of ignition plugs can be prevented, or the smoldering of ignition plugs, if it occurs, can be promptly removed.

If the answer to the question of the step 406 is No, that is, if $\theta_{TH} \leqq \theta_{THCRR}$, which means the throttle valve 3' is not sufficiently opened, it is determined at step 409 whether or not the counted value $T_{CR}$ of the $T_{CR}$ timer 511 is larger than a value corresponding to a first predetermined period of time $T_{CRRO}$ (e.g. 10.0 sec) which is larger than the second predetermined period of time $T_{CRR1}$. If the answer to the question of the step 409 is No, that is, if $T_{CR} \leqq T_{CRRO}$, the step 404 is executed, while if the answer is Yes, that is, if $T_{CR} > T_{CRRO}$, the step 408 is executed.

In automotive vehicles in general, to start the engine, the drivers normally continue cranking operation for about 15 seconds if the throttle valve 3' is kept closed. However, when the cranking operation is continued for more than about 10 seconds, the ignition plugs can smolder. Therefore, the above-mentioned first predetermined time period $T_{CRRO}$ is set to a time period before which the ignition plugs cannot smolder.

If the engine is not brought into a self-sustained operative state, i.e. a firing or idling state even after the starting operation described as above, or after repeating the starting operation, usually the throttle valve 3' will be opened above the predetermined opening $\theta_{THCRR}$ by the driver in order to again try to start the engine so that the correction of the fuel quantity will be executed by means of the coefficient $K_{CR}$ at step 408 after the lapse of the short second predetermined time period $T_{CRR1}$, thereby promptly removing the smoldering of the ignition plugs and hence improving the startability of the engine.

What is claimed is:

1. In a fuel supply control system for an internal combustion engine having an intake passage and a throttle valve arranged across said intake passage, including start detecting means for detecting a starting condition of said engine, engine temperature detecting means for detecting a temperature of said engine and generating an output indicative of the detected engine temperature, throttle opening detecting means for detecting the opening degree of said throttle valve and generating an output indicative of the detected opening degree, and fuel supply means associated with said start detecting means and said engine temperature detecting means and responsive to said output of said engine temperature detecting means, for supplying said engine with an amount of fuel required for starting said engine, when said start detecting means detects said starting condition of said engine, the improvement comprising:

time counting means associated with said start detecting means for counting time elapsed from the time said start detecting means detects said starting condition of said engine and generating an output depending upon whether or not said elapsed time is larger than a predetermined period of time, said predetermined period of time being determined by said output of said throttle opening detecting means, and fuel decreasing means responsive to said output of said time counting means, for decreasing said amount of fuel for starting said engine, to be supplied by said fuel supply means, after said predetermined period of time has elapsed.

2. A fuel supply control system as claimed in claim 1, wherein said fuel decreasing means decreases said amount of fuel for starting said engine, when the opening degree of said throttle valve detected by said throttle opening detecting means is smaller than a predetermined value, and at the same time said elapsed time counted by said time counting means is larger than said predetermined time period.

3. A fuel supply control system as claimed in claim 1, wherein said fuel decreasing means decreases said amount of fuel for starting said engine, when the opening degree of said throttle valve detected by said throttle opening detecting means is larger than a predetermined value, and at the same time said elapsed time counted by said time counting means is larger than said predetermined period of time.

4. A fuel supply control system as claimed in claim 3, wherein said fuel decreasing means decreases said amount of fuel for starting said engine, when the opening degree of said throttle valve detected by said throttle opening detecting means is smaller than said predetermined value, and at the same time said elapsed time counted by said time counting means is larger than a second predetermined period of time which is longer than said first-mentioned predetermined period of time.

5. A fuel supply control system as claimed in claim 1, wherein said fuel decreasing means inhibits said decreasing of said amount of fuel for starting said engine when the temperature of said engine detected by said engine temperature detecting means is higher than a predetermined value, and allows said decreasing of said amount of fuel for starting said engine when the detected engine temperature is lower than said predetermined value.

6. A fuel supply control system as claimed in any one of claims 1 to 5, wherein said amount of fuel for starting said engine is a basic value corresponding to the detected engine temperature, said fuel decreasing means decreasing said amount of fuel for starting said engine by multiplying said basic value by a correction coefficient.

* * * * *